US008186247B1

(12) United States Patent
Chen

(10) Patent No.: US 8,186,247 B1
(45) Date of Patent: May 29, 2012

(54) WRENCH

(76) Inventor: Yu-Tang Chen, Taichung (TW)

( * ) Notice: Subject to any disclaimer, the term of this patent is extended or adjusted under 35 U.S.C. 154(b) by 329 days.

(21) Appl. No.: 12/387,743

(22) Filed: May 8, 2009

(51) Int. Cl.
*B25B 13/46* (2006.01)

(52) U.S. Cl. ..... 81/60; 81/52; 81/29

(58) Field of Classification Search ..... 81/60, 52, 81/29

See application file for complete search history.

(56) References Cited

U.S. PATENT DOCUMENTS 6,209,423 B1 * 4/2001 Shiao ..... 81/62
6,386,072 B1 * 5/2002 Yuan-Chin et al. ..... 81/63.2
6,408,722 B1 * 6/2002 Chen ..... 81/60
6,655,237 B2 * 12/2003 Chen ..... 81/60
6,904,832 B1 * 6/2005 Chen ..... 81/63.2
7,082,861 B1 * 8/2006 Chen ..... 81/63.2
7,114,415 B1 * 10/2006 Chiang ..... 81/63.2
7,353,735 B2 * 4/2008 Patel et al. ..... 81/63

* cited by examiner

*Primary Examiner* — Monica Carter
*Assistant Examiner* — Melanie Alexander

(57) ABSTRACT

A wrench, comprising: a body, includes a handle having an appropriate shape, a containing groove disposed at an action end of the body; a ratchet is pivotally coupled to the containing groove of the body; a seal cover is covered onto the body and matched with the shape of the containing groove and the second containing groove of the body; a latch ring is latched to the latch slot of the body and the groove, such that the ratchet is pivotally coupled into the containing groove of the body, and the seal cover is sealed onto the body.

3 Claims, 17 Drawing Sheets

A-A

B

C

WRENCH

BACKGROUND OF THE INVENTION

1. Field of the Invention

The present invention relates to a wrench with a removable structure.

2. Description of the Related Art

With reference to FIG. 16 for a wrench disclosed by the inventor of the present invention in U.S. Pat. No. 6,655,237, the wrench has the advantage of a removable structure, so that the wrench can be disassembled to replace a ratchet 72 without a need of purchasing the whole set of wrench if a shaft portion 722 of the ratchet 72 is worn out by the rotation of screw components, but such wrench also has the following shortcomings.

In FIG. 17, a groove 732 disposed at an external peripheral surface of a seal cover 73 is in a semicircular shape, and comes with an open shape on a lateral side. In other words, the groove 732 has two sealed ends 733, such that when the seal cover 73 is manufactured, the seal cover 73 with two sealed ends 733 and without any groove 732 cannot be made of an iron sheet with a simple material form, so that the groove 732 can be manufactured by a machine tool. When the seal cover 73 is fixed to the machine tool, the seal cover 733 is rotated by 60 degrees. The groove 732 has sealed ends 733, and thus the shape of the groove 732 cannot be cut by a cutting machine, since the cutting machine cannot cut an object into a semicircular shape. Therefore, the seal cover 73 integrally formed by the powder injection molding method has a less strength than the seal cover 73 that is made of an iron sheet in a simple material form.

SUMMARY OF THE INVENTION

A wrench, comprising: a body, includes a handle having an appropriate shape, a containing groove disposed at an action end of the body; a ratchet is pivotally coupled to the containing groove of the body; a seal cover is covered onto the body and matched with the shape of the containing groove and the second containing groove of the body; a latch ring is latched to the latch slot of the body and the groove, such that the ratchet is pivotally coupled into the containing groove of the body, and the seal cover is sealed onto the body.

DETAILED DESCRIPTION OF THE PREFERRED EMBODIMENTS

Figure 1:
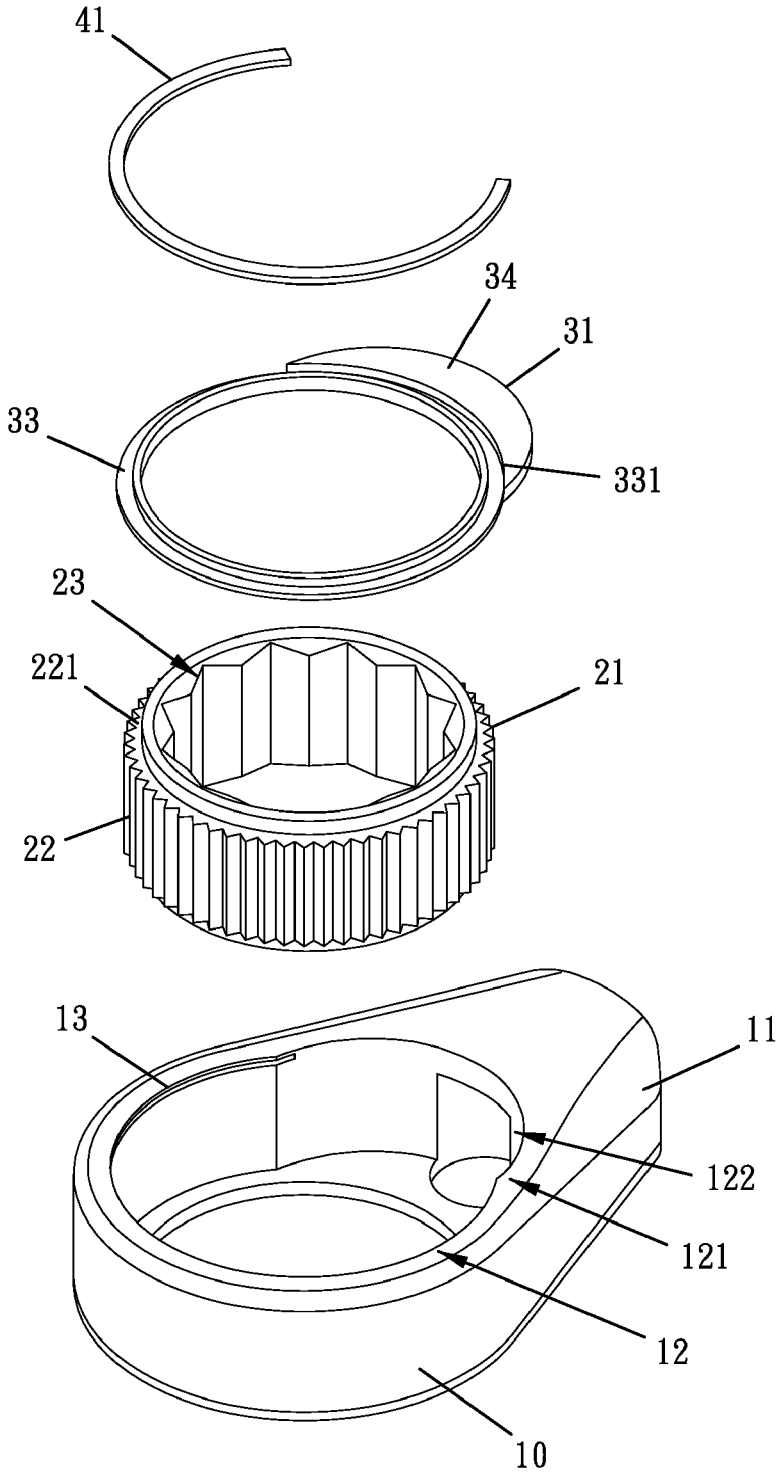
FIG. 1 shows an exploded view of the present invention.
Figure 2:
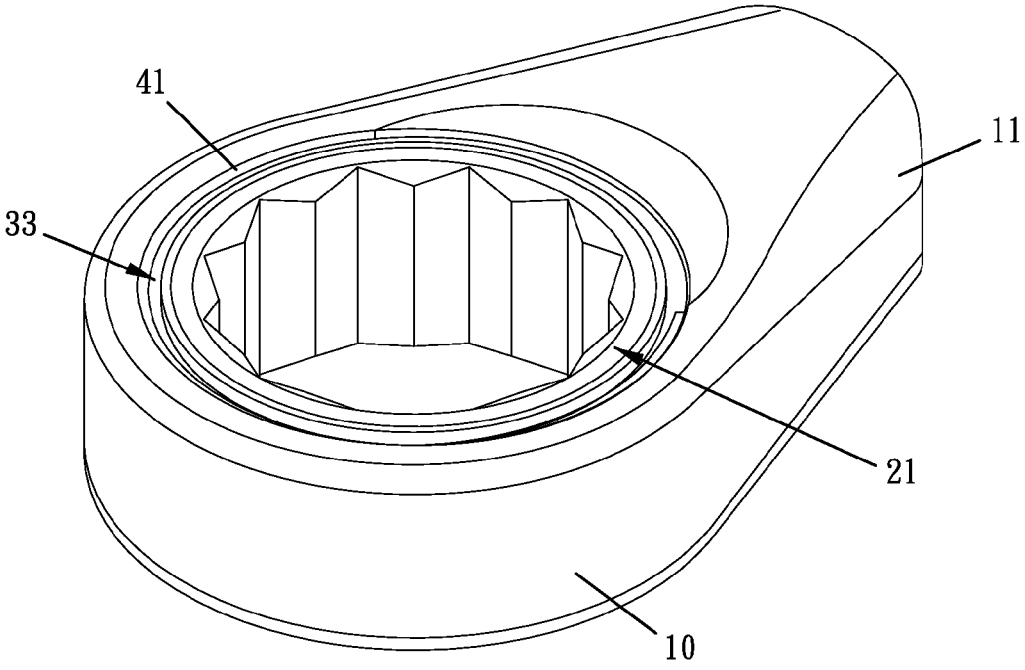
FIG. 2 shows a wrench of the invention.
Figure 3:
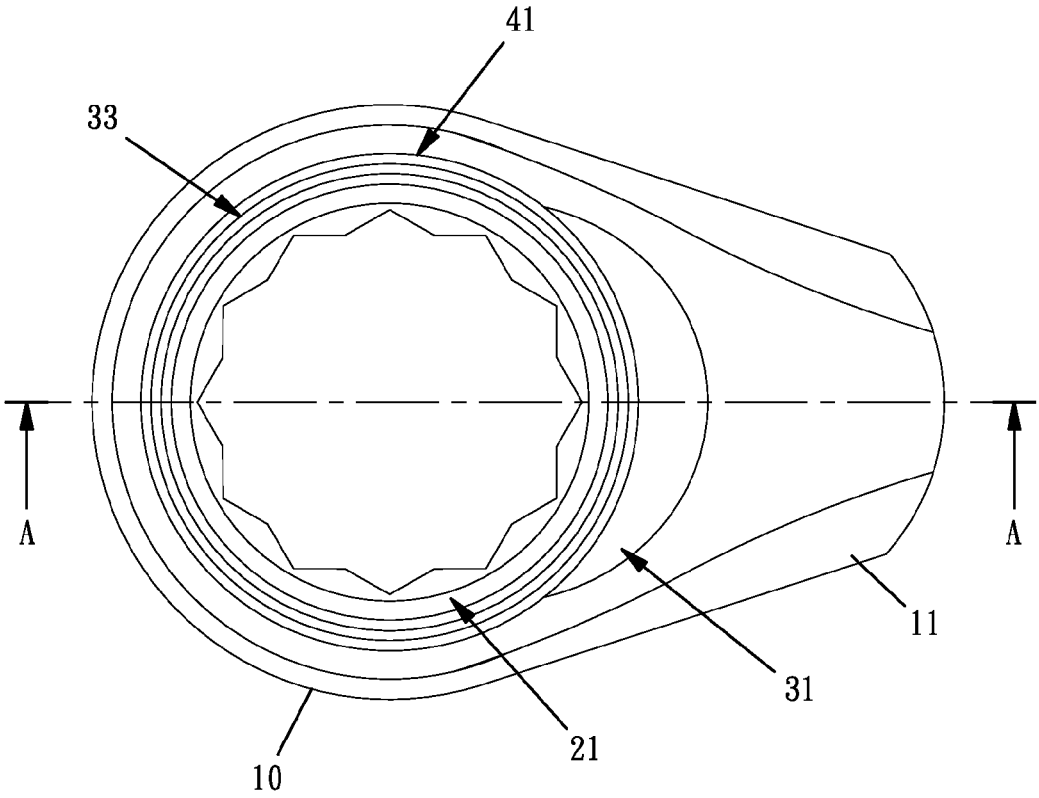
FIG. 3 shows a top view of the invention.
Figure 4:
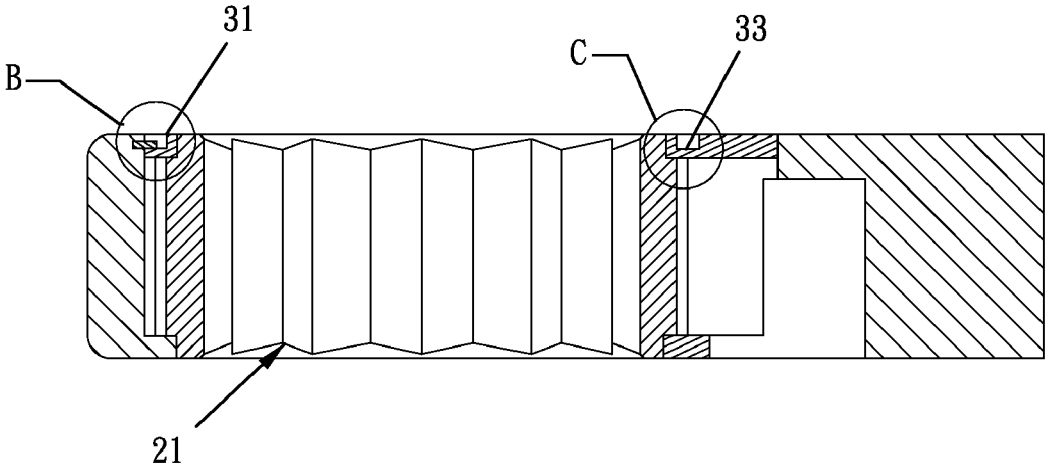
FIG. 4 shows a cross-sectional of the invention.
Figure 5:
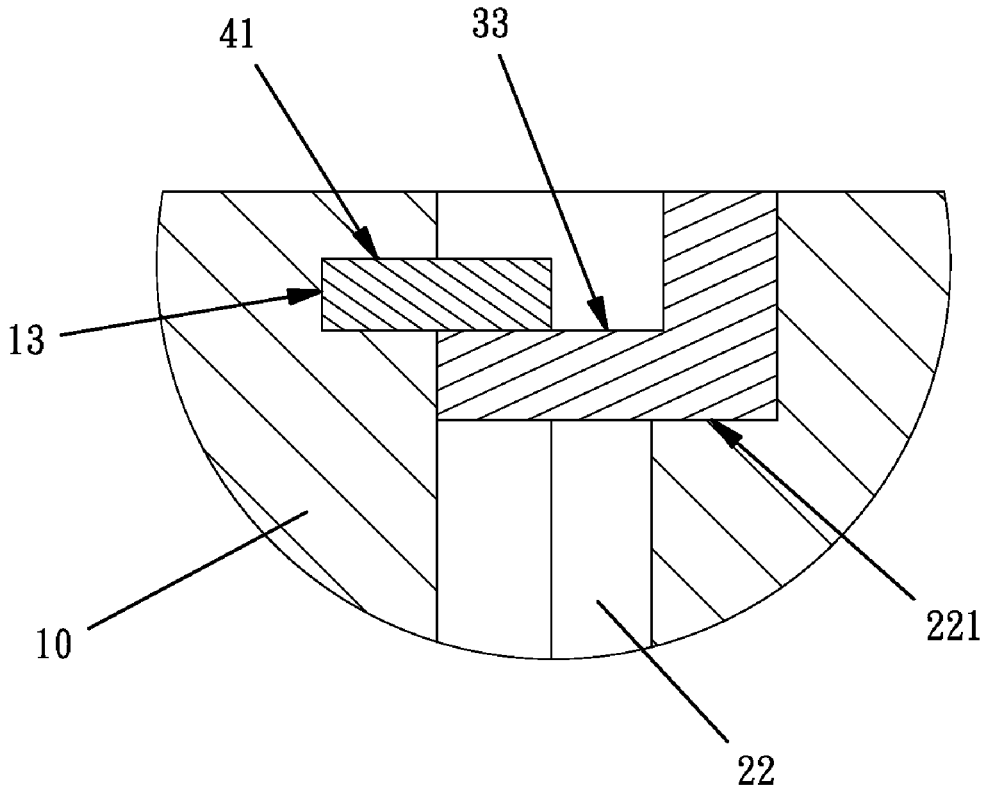
FIG. 5 shows a wrench structure of the B position in FIG. 4.
Figure 6:
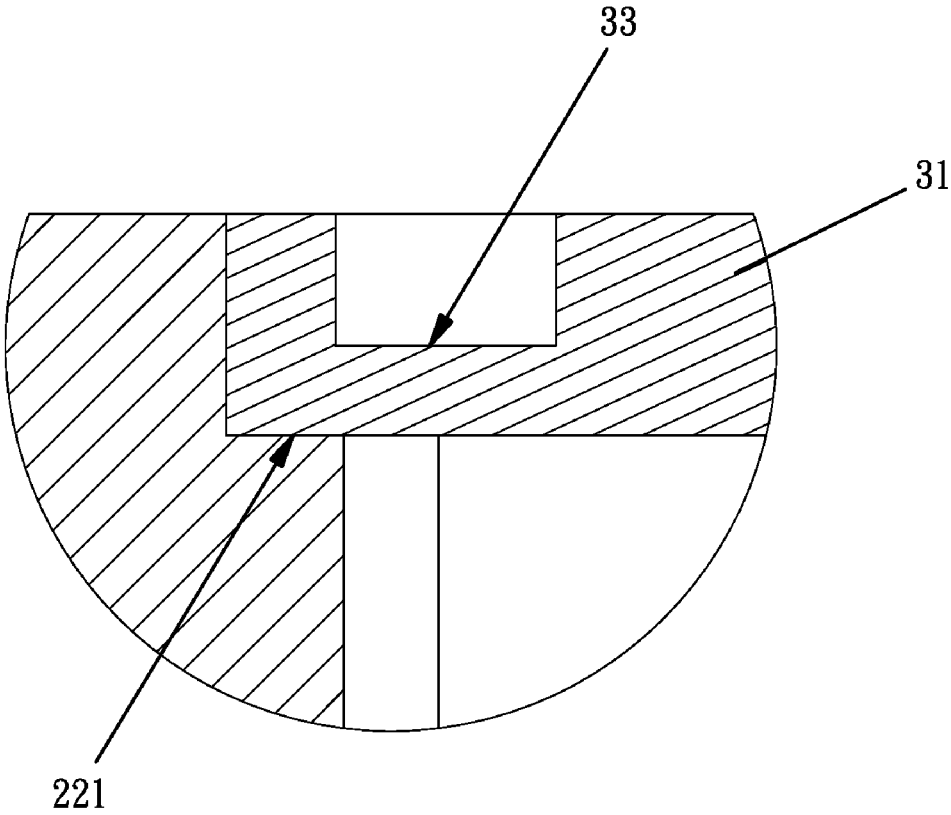
FIG. 6 shows a wrench structure of the C position in FIG. 4.

In FIG. 1, a wrench of the present invention comprises: a body 10, a ratchet 21, a seal cover 31 and a latch ring 41.

The body 10 includes a handle 11 having an appropriate shape, a containing groove 12 disposed at an action end of the body 10, and a second containing groove 121 and a third containing groove 122 for containing and installing internal components of the wrench to achieve a turning effect. A latch slot 13 is disposed at the top of the containing groove 12 and proximate to the wall of the containing groove 12.

A ratchet 21 is pivotally coupled to the containing groove 12 of the body 10, and the ratchet 21 includes a ratchet portion 22 disposed at an external peripheral surface of the ratchet 21, and the ratchet portion 22 includes circularly arranged teeth, and a distal edge of the ratchet portion 22 acts as a top portion 221, and the ratchet portion 22 has a shaft portion 23 for sheathing a screw element for its rotation.

A seal cover 31 is covered onto the body 10 and matched with the shape of the containing groove 12 and the second containing groove 122 of the body 10, and the seal cover 31 is situated at the top portion 221 of the ratchet portion 22. The seal cover 31 has a through hole corresponding to the shaft portion 23 of the ratchet 21, so that the shaft portion 23 can be exposed from the body 10. A groove 33 is disposed on the external peripheral surface of the seal cover 31, such that the groove 33 is in a circular shape and has an open shape on a lateral side. In other words, the cross-section of the seal cover 31 is substantially step-shaped. The seal cover 31 has a rear cover portion 34 disposed at a position corresponding to the second containing groove 121 of the body 10, and the rear cover portion 34 and the seal cover 31 have the same thickness and the same shape, and the groove 33 at the rear cover portion 34 of the seal cover 31 is the rear cover groove 331.

A latch ring 41 is latched to the latch slot 13 of the body 10 and the groove 33, such that the ratchet 21 is pivotally coupled into the containing groove 12 of the body 10, and the seal cover 31 is sealed onto the body 10.

If the wrench is assembled as shown in FIGS. 2 to 6, the ratchet 21 is limited by the seal cover 31 and pivotally coupled into the containing groove 12 of the body 10, and the seal cover 31 is latched by the latch ring 41 and sealed onto the body 10, so that the seal cover 31 and the ratchet 21 are limited onto the body 10, and the latch ring 41 is installed at the top of the seal cover 31. After the latch ring 41 is removed, the seal cover 31 can be removed. After the seal cover 31 is removed, the ratchet 21 can be removed for replacing internal components installed in the body 10.

Figure 7:
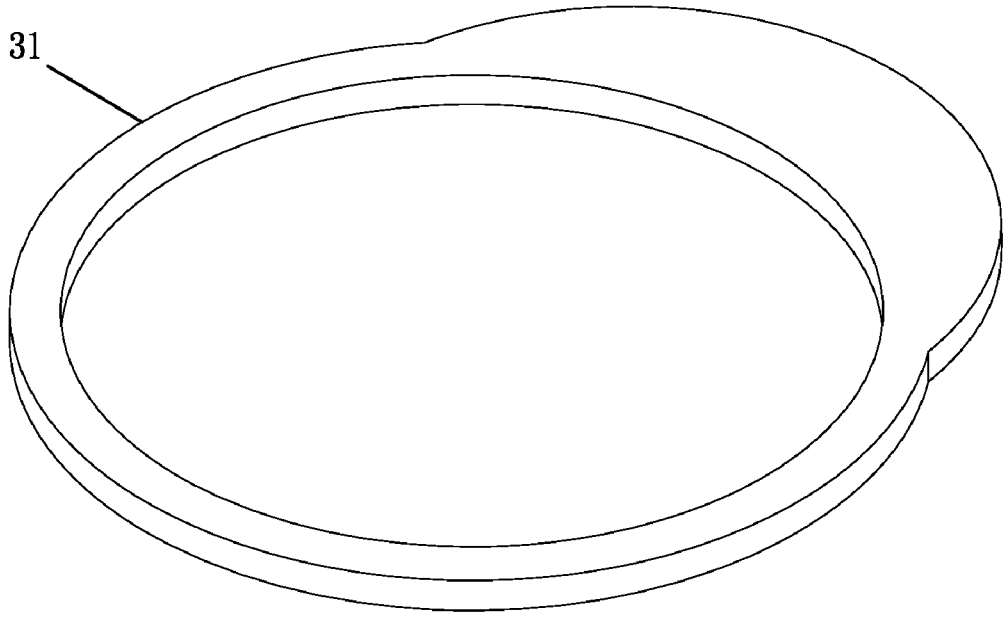
FIG. 7 shows a seal cover structure of the invention.
Figure 8:
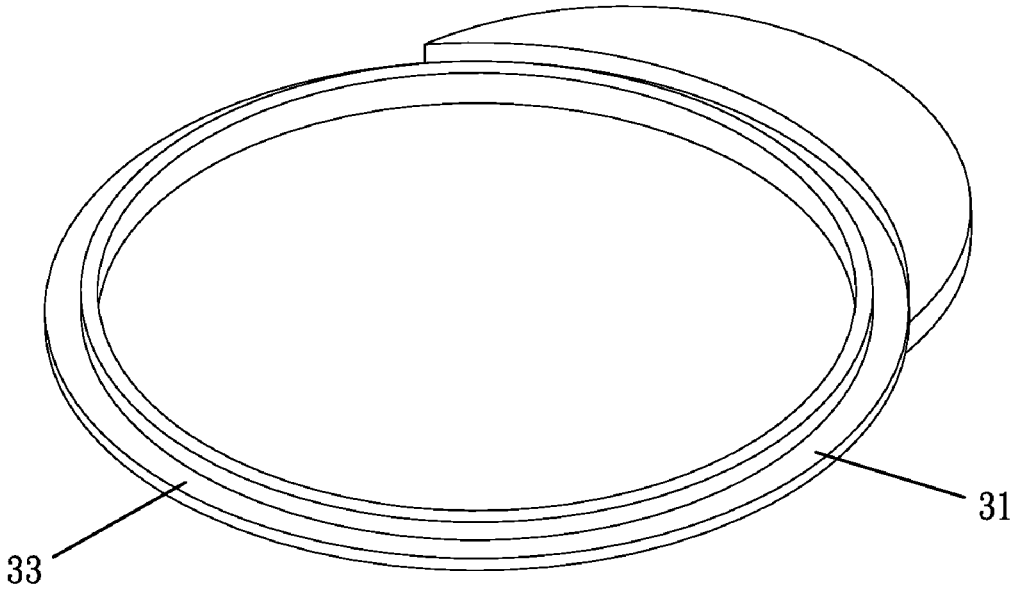
FIG. 8 shows a seal cover structure of the invention.

In FIGS. 7 and 8, the groove 33 of the seal cover 31 is in a circular shape, so that the seal cover 31 without the groove 33 can be made by pressing an iron sheet in a simple material form, and then the groove 33 is manufactured by a machine tool, wherein the seal cover 31 made of the iron sheet in the simple form provides a better strength.

Of course, the seal cover 31 of the invention can be manufactured in the same way as the prior art that presses powder to form the seal cover 31, but such seal cover 31 has less strength. However, the manufacturing method of the seal cover 31 can be changed and selected according to the using condition of the wrench, and this is another advantage of the present invention.

Figure 9:
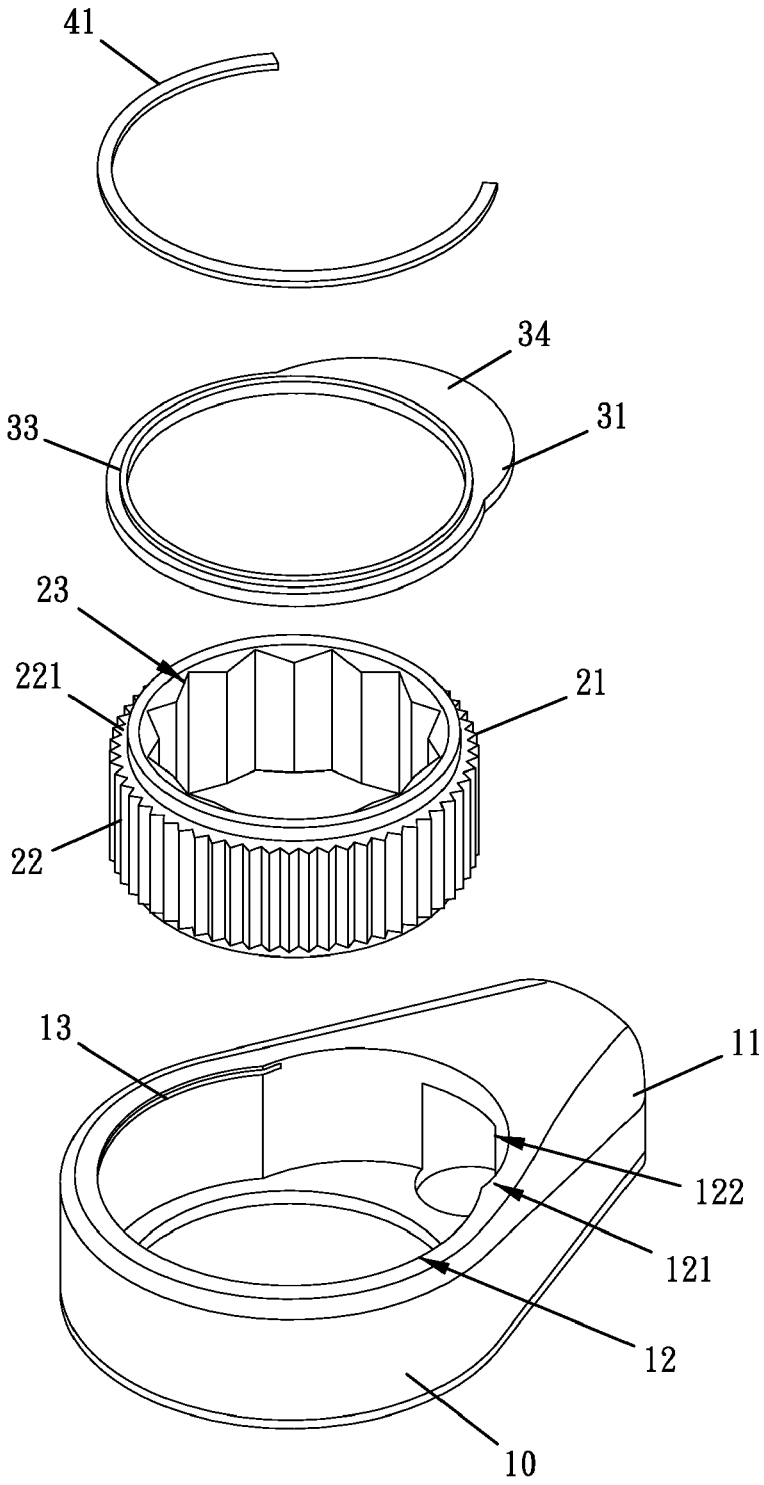
FIG. 9 shows a second preferred embodiment of the invention.

In FIG. 9, the seal cover 31 has a rear cover portion 34 disposed at a position of the second containing groove 121 of the body 10, and the rear cover portion 34 as shown in FIG. 1 has the same thickness and shape as the seal cover 31, and the rear cover portion 34 may have the same thickness and shape as the groove 33, such that after the groove 33 is cut by a machine tool, the rear cover portion 34 is milled to a thickness equal to the groove 33 by a milling machine.

Figure 10:
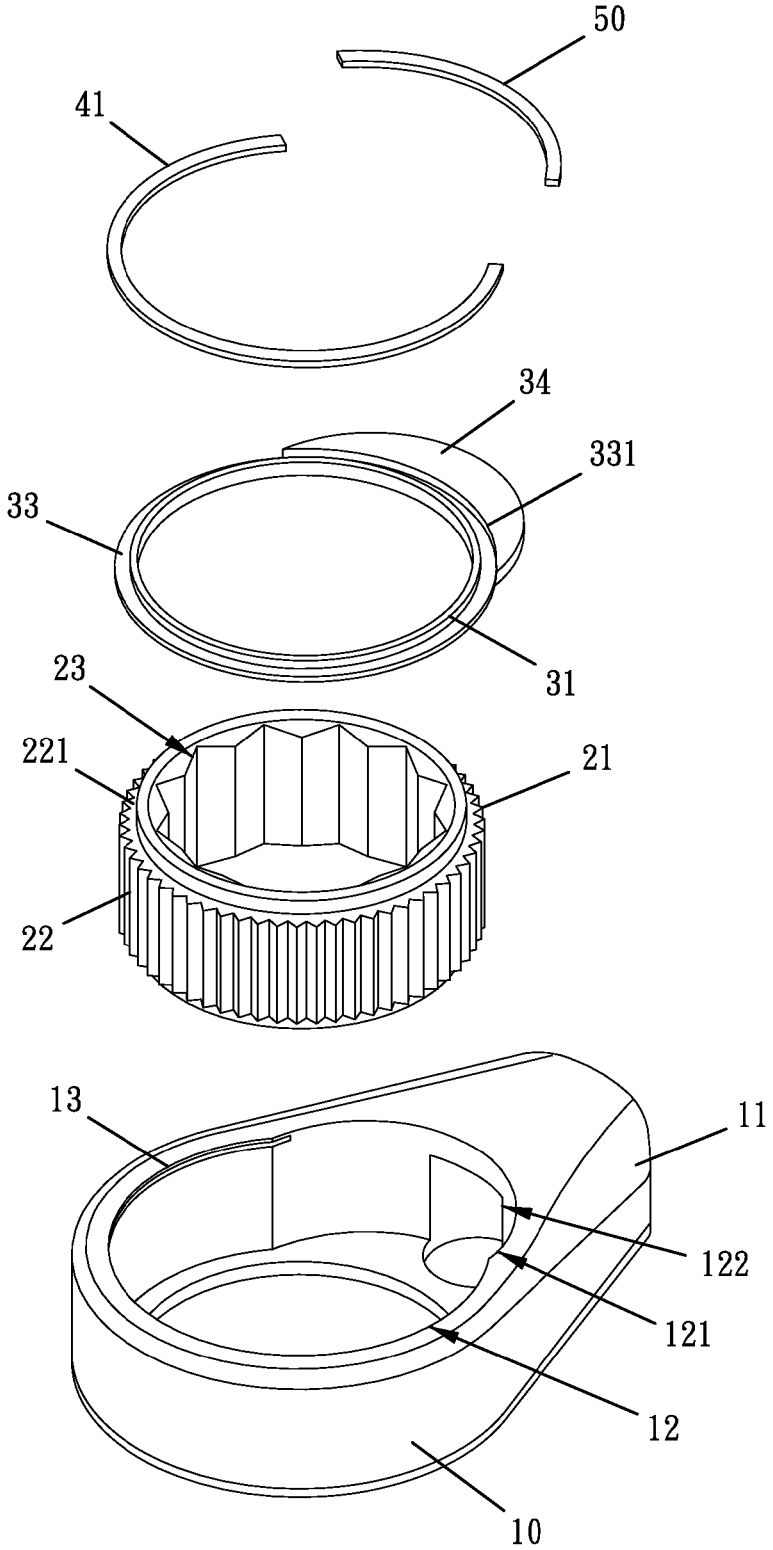
FIG. 10 shows a third preferred embodiment of the invention.

In FIG. 10, the groove 33 of the seal cover 31 at the rear cover portion 34 is a rear cover groove 331, such that when the latch ring 41 is latched onto the groove 33, a portion of the rear cover groove 331 is not covered by the latch ring 41, and thus a hood 50 can be installed onto the rear cover groove 331 to fill up the gap of the latch ring 41 and give an aesthetic appearance of the wrench.

Figure 11:
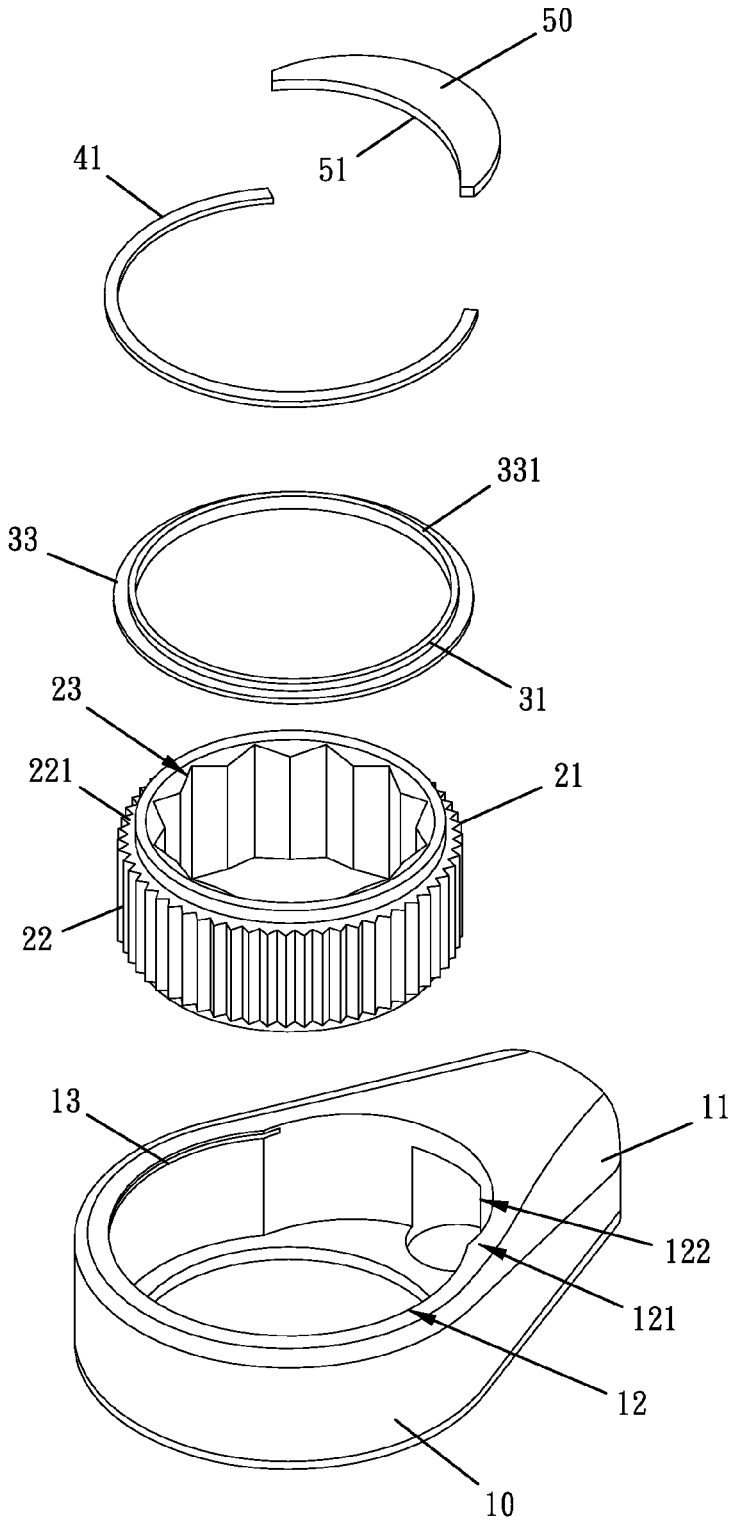
FIG. 11 shows a fourth preferred embodiment of the present invention.

In FIG. 11, the seal cover 31 can be in a circular ring shape, so that a hood 50 can be installed at a position corresponding to the second containing groove 121 for sealing, and the hood 50 includes a concave edge 51 disposed at a position corresponding to the seal cover 31 for accommodating the latch ring 41.

Figure 12:
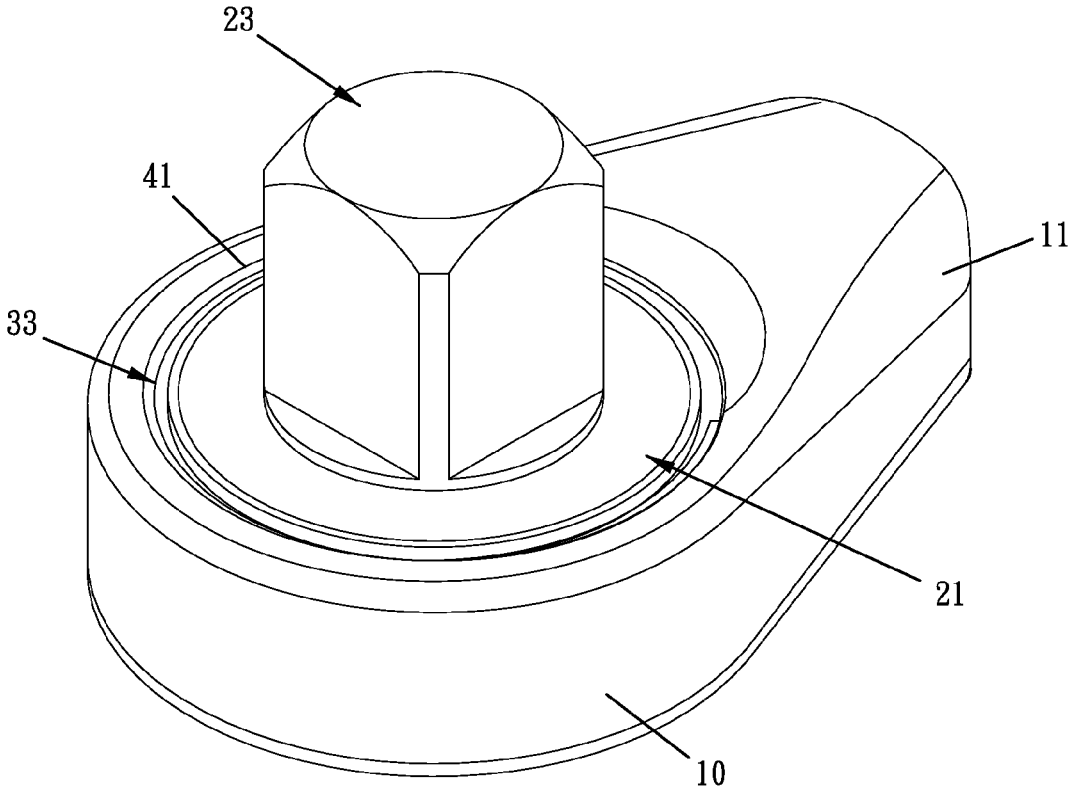
FIG. 12 shows a fifth preferred embodiment of the present invention.

In FIG. 12, the shaft portion 23 of the ratchet 21 can be a protruded tetrahedral member provided for sheathing and rotating a bushing.

Figure 13:
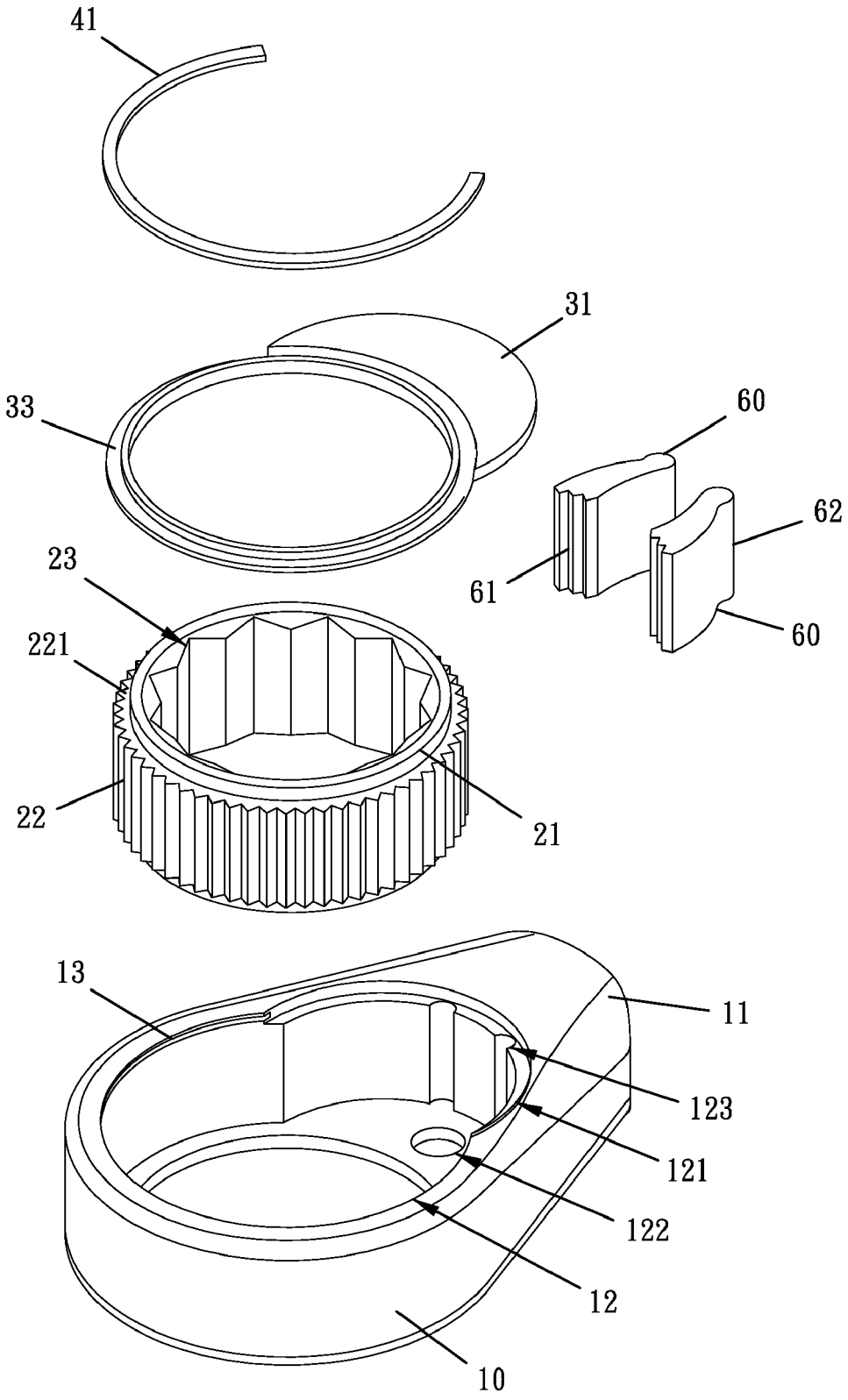
FIG. 13 shows an sixth preferred embodiment of the present invention.
Figure 14:
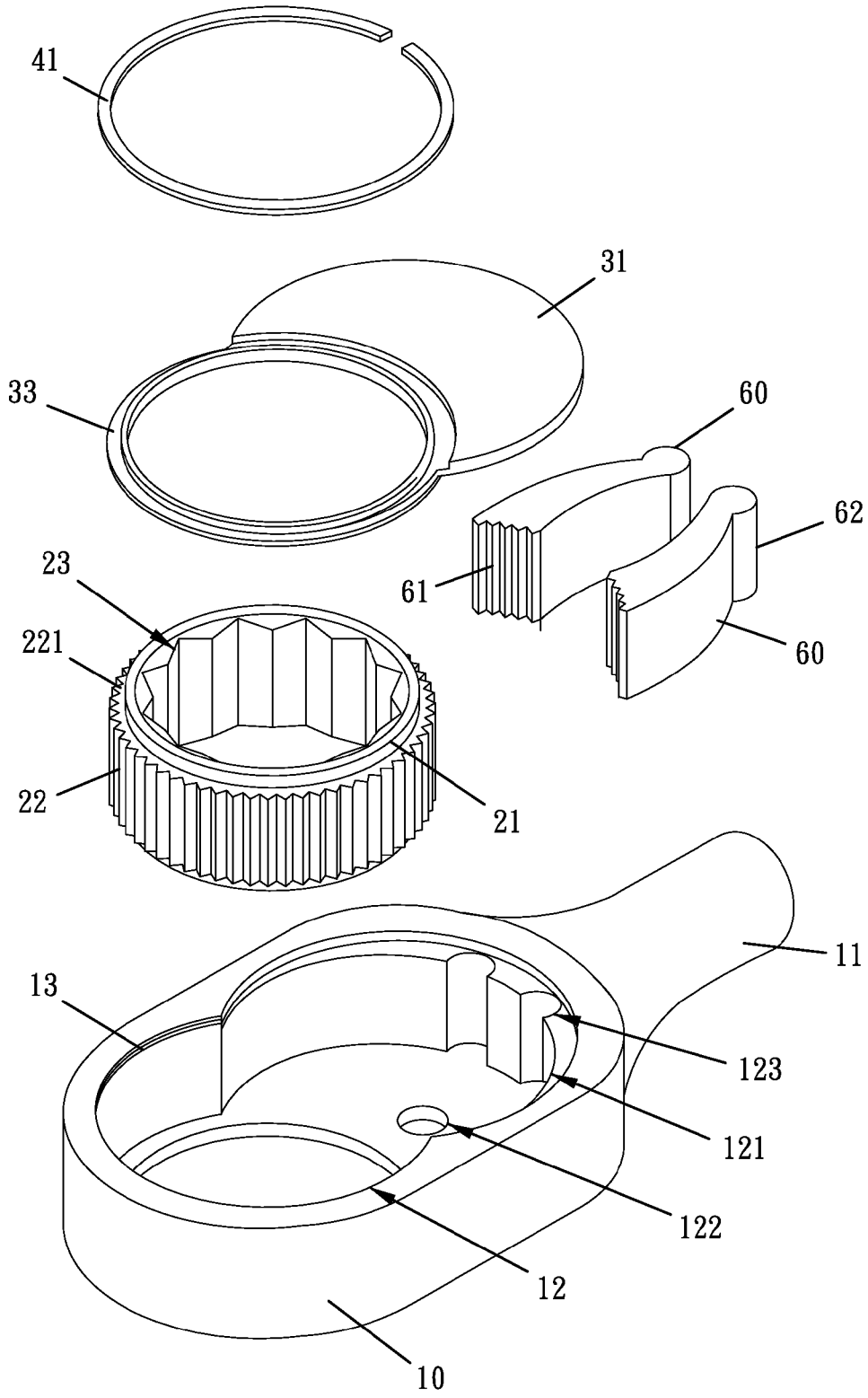
FIG. 14 shows a seventh preferred embodiment of the present invention.

In FIGS. 13 and 14, if the present invention is applied to left and right pieces of a wrench, two symmetric pivotal containing grooves 123 are disposed on a peripheral surface at the bottom of the second containing groove 121 of the body 10, and latch teeth 61 are disposed at an end of two corresponding symmetric brake teeth 60 and engaged with the ratchet portion 22 of the ratchet 21, and the pivotal portion 62 is disposed at another end and pivotally coupled to the pivotal containing groove 123.

Figure 15:
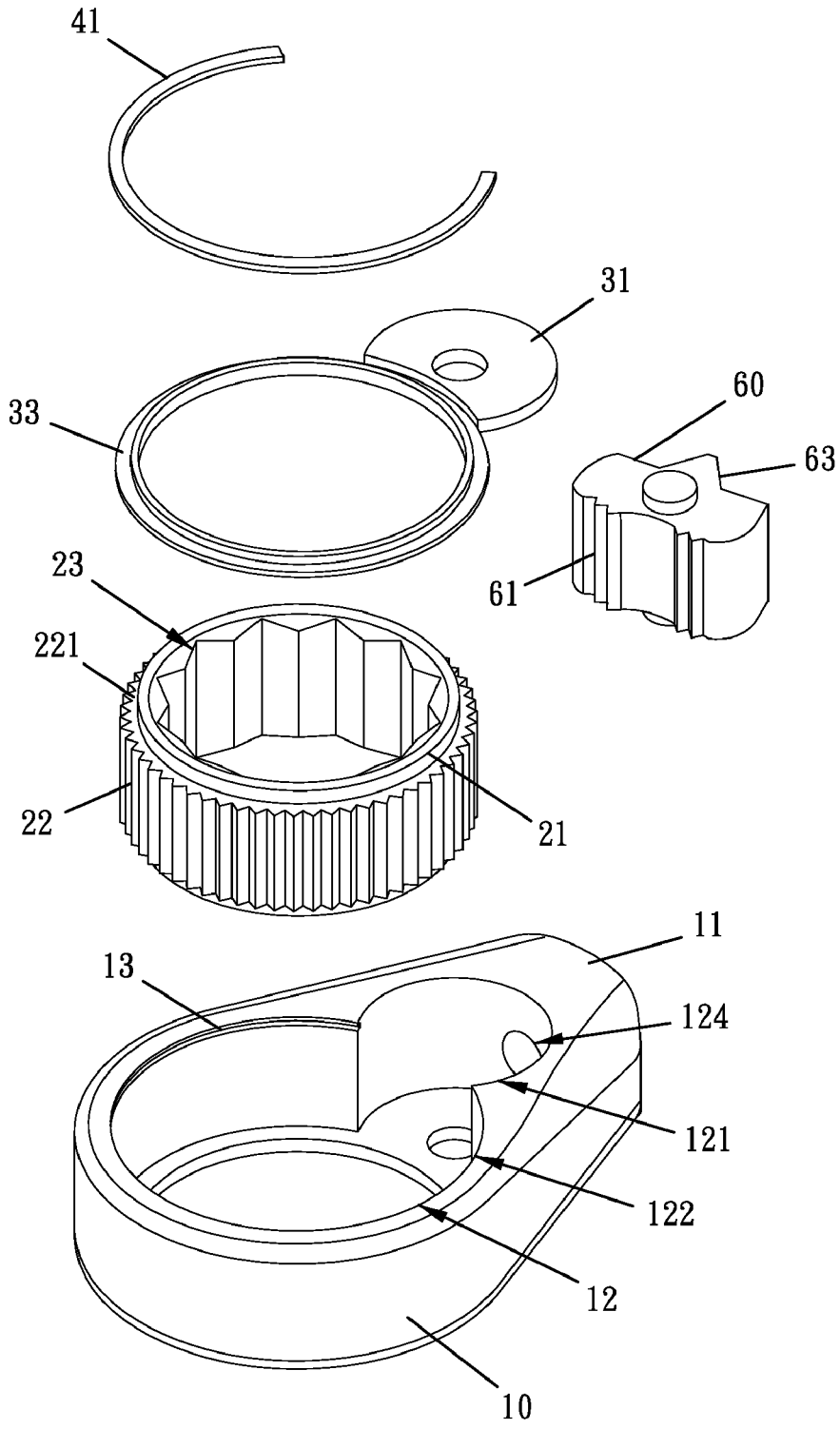
FIG. 15 shows a eighth preferred embodiment of the present invention.
Figure 16:
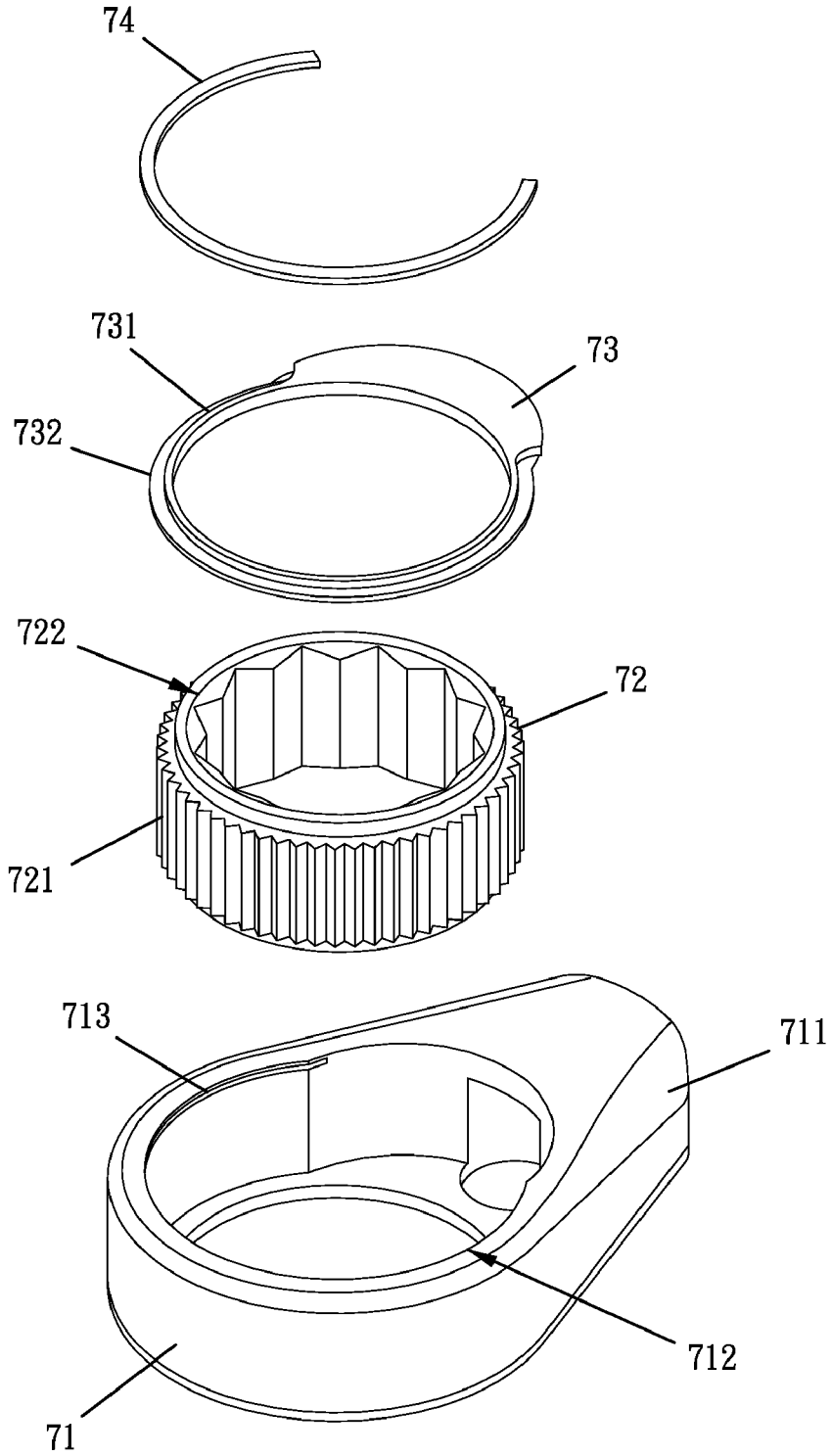
FIG. 16 PRIOR ART
FIG. 16 shows an exploded view of the conventional wrench structure.
Figure 17:
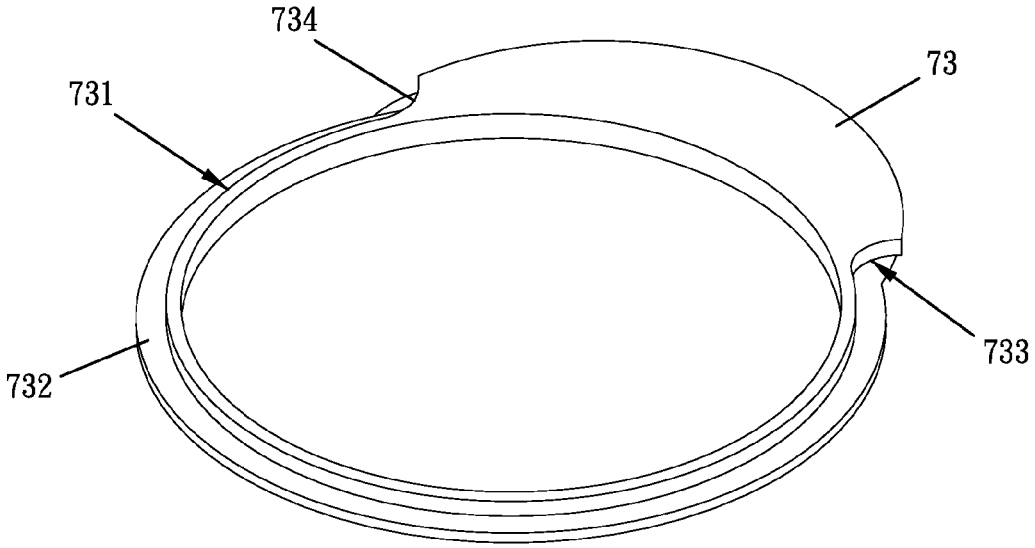
FIG. 17 PRIOR ART
FIG. 17 shows a conventional wrench structure.

In FIG. 15, if the present invention is applied to a horn gear wrench, the body 10 has a bead hole 124 disposed at the bottom of the second containing groove 121, a brake tooth 60 pivotally coupled into the second containing groove 121, symmetric latch teeth 61 disposed on both sides of a front end of the brake tooth 60 and engaged with teeth of the ratchet portion 22 of the ratchet 21, and a bead top surface 63 disposed at another end for accommodating a bead into the bead hole 124 and abutted by an elastic element to provide a positioning effect.

What is claimed is:

1. A wrench, comprising:

a body, includes a handle having an appropriate shape, a containing groove disposed at an action end of the body, and a second containing groove and a third containing groove for containing and installing internal components of the wrench to achieve a turning effect, a latch slot is disposed at the top of the containing groove and proximate to the wall of the containing groove;

a ratchet is rotatably received into the containing groove of the body, and the ratchet includes a ratchet portion disposed at an external peripheral surface of the ratchet, and the ratchet portion includes circularly arranged teeth, and a distal edge of the ratchet portion acts as a top portion, ratchet portion having a shaft portion for sheathing a screw element for its rotation, the shaft portion of the ratchet being alternated to a protruded tetrahedral member provided for sheathing and rotating a bushing;

a seal cover is covered onto the body and matched with the shape of the containing groove and the second containing groove of the body, and the seal cover is situated at the top portion of the ratchet portion, the seal cover has a through hole corresponding to body, a groove is continuously disposed around the entire external peripheral surface of the seal cover, such that the groove is in a circular shape and has an open shape on a lateral side, in other words, the cross-section of the seal cover is substantially step-shaped, the seal cover has a rear cover portion disposed at a position corresponding to the second containing groove of the body, and the groove at the rear cover portion of the seal cover is the rear cover groove;

a latch ring is latched to the latch slot of the body and the groove, such that the ratchet is rotatably received into the containing groove of the body, and the seal cover is sealed onto the body.

2. The wrench as claimed in claim 1, wherein a portion of said rear cover portion and a portion of the seal cover are the same curved shape and have the same thickness.

3. The wrench as claimed in claim 1, wherein said groove of the seal cover at the rear cover portion is a rear cover groove, and thus a hood is installed onto the rear cover groove.

* * * * *